United States Patent [19]

Scholz

[11] 4,285,262

[45] Aug. 25, 1981

[54] TREMOLO DEVICE

[76] Inventor: D. Thomas Scholz, 13 Rich Valley Rd., Wayland, Mass. 01778

[21] Appl. No.: 33,155

[22] Filed: Apr. 25, 1979

Related U.S. Application Data

[63] Continuation-in-part of Ser. No. 931,610, Aug. 7, 1978, abandoned.

[51] Int. Cl.[3] ..... G10D 3/12

[52] U.S. Cl. ..... 84/313; 84/312 P

[58] Field of Search ..... 84/313, 312 P

[56] References Cited

U.S. PATENT DOCUMENTS

| | | | |
|---|---|---|---|
| 3,237,502 | 3/1966 | Moseley | 84/313 X |
| 3,248,991 | 5/1966 | Cole | 84/313 |
| 3,326,072 | 6/1967 | Price | 84/313 |
| 3,990,341 | 11/1976 | Pace | 84/313 |
| 4,171,661 | 10/1979 | Rose | 84/313 |

FOREIGN PATENT DOCUMENTS

| | | | |
|---|---|---|---|
| 683531 | 2/1965 | Italy | 84/313 |

*Primary Examiner*—Lawrence R. Franklin

*Attorney, Agent, or Firm*—Wolf, Greenfield & Sacks

[57] ABSTRACT

A guitar tailpiece assembly includes a tremolo device by which the strings may be stretched or relaxed in an oscillating manner and which also minimizes the tendency for some of the strings to shift out of tune as a result of using the tremolo device or when "bending" a note. The tremolo device includes means by which all of the strings can be retuned simultaneously, for example, when transposing the tuning of the guitar so that it is in tune with another instrument.

21 Claims, 11 Drawing Figures

TREMOLO DEVICE

BACKGROUND AND SUMMARY OF THE INVENTION

This application is a continuation-in-part of my prior co-pending application Ser. No. 931,610 filed Aug. 7, 1978, now abandoned.

This invention relates to guitar tailpiece units and, particularly, to a guitar tailpiece unit which incorporates a tremolo device, i.e., a device which enables rapid oscillations of pitch. While a variety of such devices have been in use for some time, they generally tend to present one or more of a number of difficulties. For example, among the most common difficulties encountered with guitar tremolo devices is that after the strings have been stretched (or relaxed) they sometimes do not tend to return precisely to their original positions with respect to the bridge and nut and, therefore, go out of tune. Also among the difficulties with the prior devices is that even when they do stretch (or relax) the strings uniformly, that does not result in a uniform change in pitch of all of the strings. Rather, some of the strings display greater pitch change than others with the result that the chord, during tremolo, is not true. A further difficulty with the prior devices occurs when the musician "bends" a note (i.e., raising the pitch of one or two of the strings by bending them laterally at some point along the fingerboard). Bending one or two strings increases the tension in those strings and often tends to cause the tremolo bar to shift slightly which, in turn, changes the pitch of the other strings. Still another difficulty encountered with the prior devices is that, in the event that a string breaks, the reduced pull of the remaining strings on the tremolo device tends to result in a tightening of those strings by the tremolo device which throws the remaining strings out of tune, necessitating retuning of the entire instrument even after the broken string is replaced.

The present invention includes a tremolo device which overcomes or, at least, significantly reduces the above difficulties encountered with prior devices. Briefly, my invention includes a pivotable tremolo bar which is located behind the bridge and may be rocked back and forth about a generally transversely extending fulcrum. The tremolo bar has a forward anchor position and a rearwardly extending portion. The tails of the strings are attached to the anchor portion of the tremelo bar, which is preferably L-shaped. The fulcrum is located adjacent the forward end of the tremolo bar, preferably below the point of attachment of the strings. The tremolo bar is maintained in a predetermined "normal" position by a holddown means which includes a relatively heavy spring arrangement which overlies and normally engages the rear end of the rear extension of the tremolo bar, thereby providing a stop for the tremolo bar. In one embodiment of the invention, means are provided for limiting the lowermost position of the barengaging portion of the spring thereby determining the level at which the spring will maintain the rear extension of the tremolo bar when in its normal position. The downwardly directed resistance of the spring is more than sufficient to resist and balance the moment applied to the tremolo bar by the tension of the strings. A tremolo effect is achieved by oscillating a tremolo handle which is attached to the tremolo bar. The tremolo handle may be operated in either or both directions, to effect tremolo by oscillations in the tension of the strings. After the tremolo effect has been completed and handle is released, the spring returns to its normal position against its stop, thereby returning the tremolo bar to its normal position and the strings to their original tensions and tuning.

In another embodiment of the invention, the spring arrangement includes a pair of leaf springs which are selected and arranged so that their additive forces are required to maintain the tremolo bar in its normal position. The springs are arranged so that when the tremolo bar is operated to increase the tension of the strings, the springs impart a progressively reduced biasing force, and when the tremolo bar is pivoted to release the tension on the strings, both springs cooperate to provide a progressively increasing opposing force. This arrangement of springs provides an improved feel for the musician in that the force required to operate the tremolo bar in either direction is more balanced.

The invention also includes means to adjust the normal position of the tremolo bar to enable the tension in all of the strings to be varied simultaneously and in a relatively permanent manner, thereby enabling the pitch of all of the strings to be changed simultaneously. This is very desirable when the guitar player is playing in a group, with other musicians. Should the guitar be slightly out of tune with the other instruments in the group, all of the strings on the guitar may be retuned to a transposed key which is in tune with the other instruments, by making a slight and simple adjustment. To this end the device is provided with a heightwise adjustable nut having a shoulder which engages the underside of the free end of the spring arrangement and serves as the spring stop to limit the extent to which the spring can urge the rear portion of the tremolo bar downwardly. The nut is accessible through a hole formed in the cover for the tailpiece and, by making slight adjustments to the nut, the lowermost position of the spring can be varied, thereby effecting slight variations in the angular attitude of the tremolo bar.

The tailpiece preferably is employed in conjunction with a guitar having a low friction bridge and nut, such as, for example, one which utilizes individual rollers to support the strings.

It is among the general objects of the invention to provide an improved tremolo device for a guitar.

Another object of the invention is to provide an improved guitar tailpiece assembly which enables a tremolo effect to be generated either by stretching or relaxing the strings from their normal tensions.

A further object of the invention is to provide a tremolo device having means for simultaneously and uniformly adjusting the tension of all of the strings of the guitar to facilitate rapid transposing of the tuning of the guitar.

Another object of the invention is to provide a guitar having a tremolo device which displays no significant tendency to shift out of tune after operation of the tremolo device.

A further object of the invention is to provide a tremolo device which stretches and/or relaxes the strings in a manner which maintains a true chord throughout operation of the tremolo device.

Another object of the invention is to provide a tremolo device having a movable tremolo bar which displays a balanced feel during operation.

Still another object of the invention is to provide a tremolo device which maintains true pitch of the strings and in which the strings maintain their proper original tension even during bending of some of the strings.

DESCRIPTION OF THE DRAWINGS

The foregoing and other objects and advantages of the invention will be appreciated more fully from the following further description thereof, with reference to the accompanying drawings wherein.

DESCRIPTION OF A PREFERRED EMBODIMENT

Figure 1:
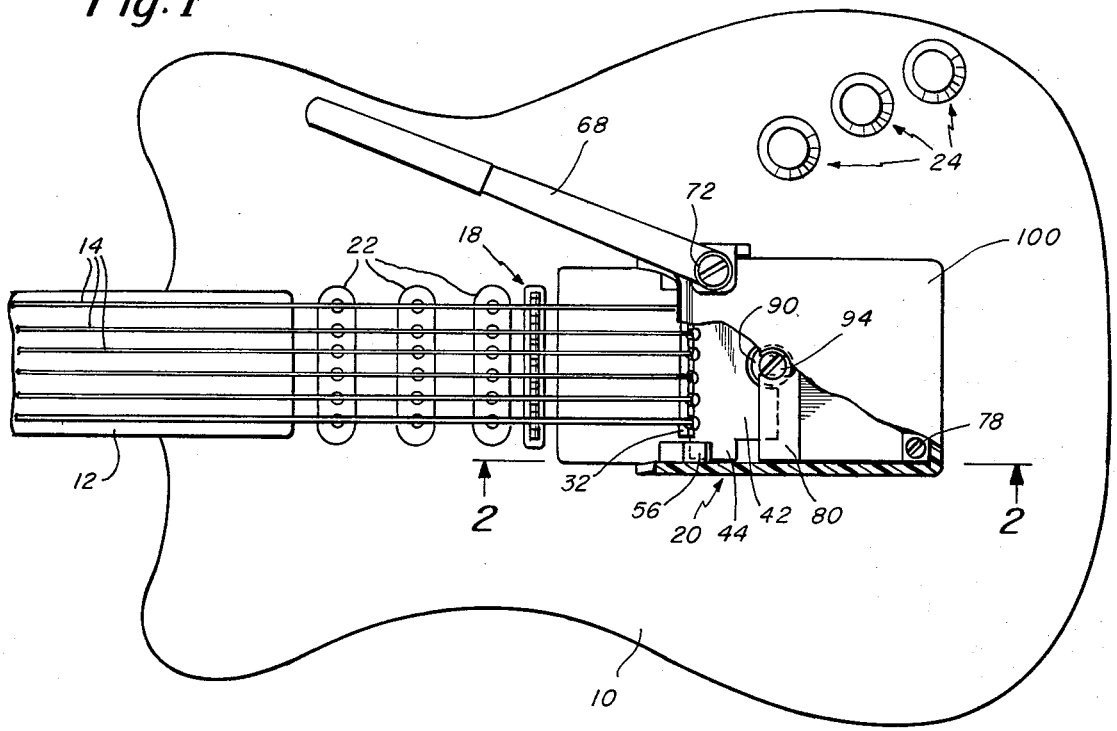
FIG. 1 is a plan view of a guitar body having the improved guitar tailpiece assembly mounted thereon.

FIG. 1 shows the invention as embodied in an electric guitar having a body 10 which may be solid. A neck 12 extends from the body 10 and terminates in a head (not shown) having tuning pegs or other means to which the ends of the strings 14 are attached. The strings 14 extend rearwardly from the head, over a nut, over the neck 12, and then over a bridge 18. The strings 14 are attached to a tailpiece located rearwardly of the bridge 18. The tailpiece includes a tremolo device, indicated generally at 20. In the guitar configuration shown in FIG. 1, there are three electromagnetic pickup units mounted to the body 10 below the strings 14. The guitar includes a number of control knobs, switches, etc. 24, outlet jacks (not shown) and like electric devices which are typically found in electric guitars.

The tailpiece 20 includes a base plate 24 which is securely mounted to the body 10 of the guitar. The base plate 24 may be stamped from sheet steel and may be formed to include a number of cut-out portions 26 and/or holes by which the base plate 24 may be secured to the guitar body 10, as by screws 28.

Figure 2:
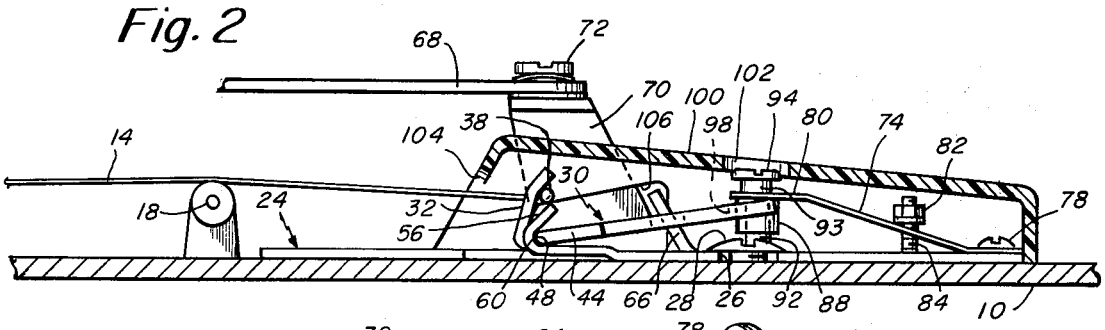
FIG. 2 is a side elevation, partly in section, of the device shown in FIG. 1 as seen along line 2—2 of FIG. 1 with the tremolo bar in its normal attitude.
Figure 3:
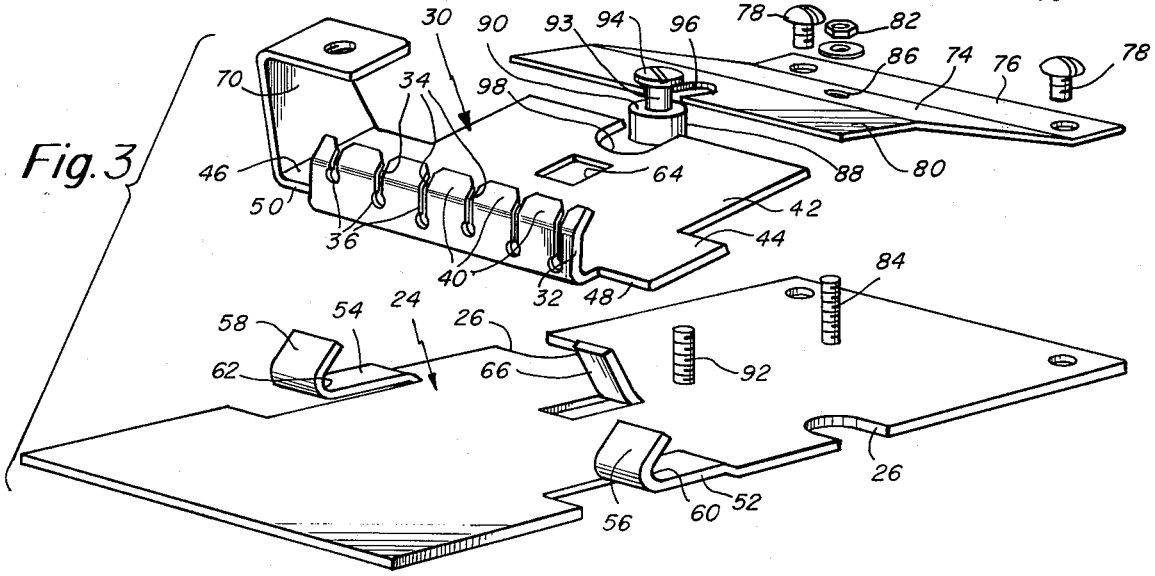
FIG. 3 is an enlarged exploded view of the tremolo device.

The base plate 24 carries a tremolo bar, indicated generally by the reference character 30, which also may be formed from sheet metal. The tremolo bar 30 is formed to include a forward, upwardly extending anchor portion 32 to which the tail ends of the strings are secured. The strings 14 are attached to the anchor portion 32 by slipping their tail portions downwardly into transversely spaced vertical slots 34 which are formed in the anchor portion 32. The lower end of each of the slots 34 terminates in an enlarged hole 36 which cooperates with a ball 38 secured to the tail end of each string, to retain the string 14. Thus, the anchor portion 32 of the bar 30 may be considered as having a plurality of transversely spaced fingers 40, which retain a string between each pair of adjacent fingers 40. The upper ends of each of the fingers 40 are bent slightly rearwardly as shown in FIGS. 2 and 3 to insure that the string balls 38 will be retained firmly. It should be noted that in FIG. 2 only one string 14 is shown, for clarity of illustration.

The tremolo bar 30 is mounted to the base plate 24 for limited pivotal movement about a transversely extending axis which may be disposed below the point of attachment of the strings 14 to the anchor portion 32 of the tremolo bar. The tremolo bar 30, which in the embodiment shown is L-shaped, includes a rearwardly extending portion 42 which is formed to include a pair of laterally extending fulcrum projections 44, 46. The projections 44, 46 have forwardly facing edges 48, 50, respectively, which serve as the pivot points for the tremolo bar 30.

The tremolo bar 30 is supported at its projections 44, 46 by a pair of transversely spaced fulcrum lugs 52, 54 which are formed integrally with and stamped out from the lateral edges of the base plate 24. The outer end of each of the fulcrum lugs 52, 54 is bent upwardly and rearwardly, as indicated at 56, 58 to define a pair of laterally-spaced fulcrum sockets 60, 62 which are receptive to the tremolo bar projections 44, 46. The inwardly facing edges of the lugs 52, 54 and ends 56, 58 are spaced with respect to the width of the bar 30 to retain the bar 30 between the lugs 52, 54 and preclude the bar 30 from shifting laterally. The forwardly facing fulcrum edges 48, 50 of the projections 44, 46 may be rounded or otherwise shaped to provide a smooth pivot point for the tremolo bar 30. In addition, the bar 30 also is provided with a central hole 64 which receives an upwardly and forwardly extending tongue 66 which is stamped out of the base plate 24. The tongue 66 and hole 64 cooperate to restrain the bar from lateral shifting movement and also to facilitate assembly of the tremolo bar 30 and base plate 24.

The tremolo bar 30 may be operated, by pivoting it in a direction which will vary the tension of the strings 14, by a handle 68 which is connected to the tremolo bar 30. To this end, one of the projections 46 includes an integrally-formed extension bracket 70 which extends upwardly from the bar 30 and which provides a means by which the handle 68 may be attached. Preferably, the handle 68 is attached by a screw 72 or similar connection which will enable the angular attitude of the handle 68 to be adjusted to suit the individual musician.

From the foregoing, it will be appreciated that when the strings 14 are tensioned, they will apply a force to the tremolo bar, to bias the bar in a counterclockwise direction (as seen in FIG. 2) tending to raise the rearwardly extending portion 42 of the bar 30. In order to resist the force of the strings and to maintain the bar 30 in a fixed, normal position, restraining means are provided to apply a force against the rearwardly extending portion 42 of the bar 30 sufficient to resist and balance the moment applied to the bar 30 by the tension of the strings 14. In the embodiment shown in FIGS. 1–5, the balancing force is achieved by a stiff spring, such as a leaf spring 74 which is secured, at its rearward end 76 to the rear end of the base plate 24, as by screws 78. The leaf spring 74 extends forwardly and upwardly with a forwardmost portion 80 disposed above the rear portion 42 of the tremolo bar 30. The leaf spring 74 is selected and designed so that it will apply a downward balancing force to the rear portion of the bar 30 to overcome the moment on the bar applied by the strings 14 and to hold the bar in a normally fixed position. It will be appreciated, therefore, that the spring 74 is relatively stiff and, if desired, may be formed from a plurality of leaves. As will be described in more detail below, means are provided for pre-loading the spring 74 so that it bears downwardly with the force considerably greater than that required merely to resist the effect of the tension of the strings 14. Means also are provided for limiting the extent to which the free end of the spring 74 can move downwardly and, when in a normal configuration, as shown in FIG. 2, the rearward portion 42 of the tremolo bar 30 will bear upwardly against the leaf spring 74 which will serve as a stop to maintain the tremolo bar 30 in its normal position. As will be described, the leaf spring 74 may be resiliently moved from its normal position when the tremolo device is operated.

The preloading, downward force of the spring 74 may be increased (or decreased, if desired) by an adjustment nut 82. The nut 82 is threaded onto the upper end of a post 84 which is secured to and extends upwardly from the base plate and which passes through a hole 86 in the spring 74. By varying the position of the nut 82 on the post 84, it may be seen that the downward force of the spring 74 can be varied considerably. Thus the spring 74 is preloaded, by the nut 82 so that its outer, free end 80 may bear downwardly under a force greater than that required to counterbalance the moment applied by the strings 14.

The position of the free end 80 of the spring 74 is controlled by a control nut 88 which is supported by the base plate at a location below the forward portion 80 of the leaf spring 74. The control nut is provided with a shoulder 90 which provides a support surface for the forward end 80 of the leaf spring 74. The nut 88 is threaded onto a post 92 which is secured to and extends upwardly from the base plate 24. The height of the control nut 88 on the post 92 may be adjusted by a screw head 94 (preferably slotted) which extends upwardly from and is integral with the nut 88. The forward end 80 of the leaf spring 74 is formed to include a slot 96 through which a narrowed portion 93 of the nut 88 may extend. Thus, the forward portion 80 of the leaf spring 74 normally rests against the shoulder 90 which defines the lowermost position of the forward portion 80 of the spring 74. The uppermost limit of the portion 80 of the spring 74 is limited by the screw head 94. The portion 42 of bar 30 also has a larger slot 98 large enough to accommodate and pass freely about the nut 88.

When the device is in its normal configuration (FIG. 2). the nut 88 will be at a predetermined height on its post 92 and the nut 82 will have been adjusted so that the forward end 80 of the spring 74 bears down firmly against the shoulder 90 of the nut 88. The spring 74 is selected and the nut 82 is tightened down so that when the strings 14 are properly tensioned to their intended tuning, the moment applied by the rearward portion 42 of the bar 30 against the underside of the forward end of the leaf spring 74 will be insufficient to raise the leaf spring from its seated position on the shoulder 90 of the nut 88.

Figure 4:
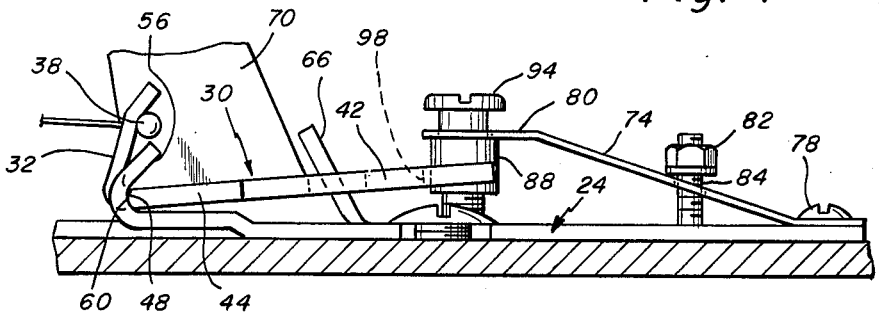
FIGS. 4 and 5 are diagrammatic illustrations somewhat similar to FIG. 2 illustrating the position of the tremolo bar.
Figure 5:
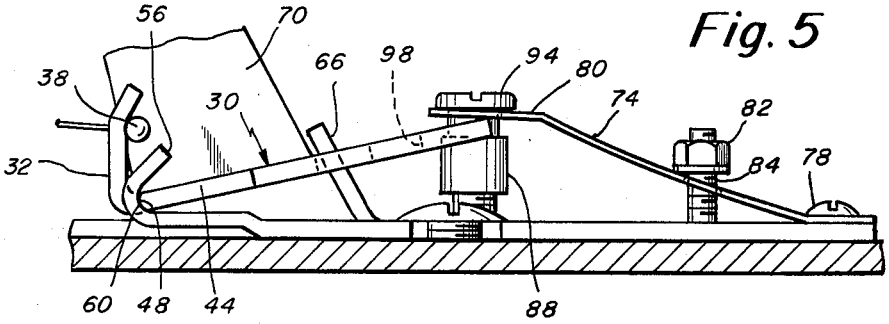

As illustrated in FIGS. 4 and 5, a tremolo effect can be obtained by operating the handle 68 to move it toward and away from the body 10 of the guitar. When the handle 68 is moved toward the body 10 of the guitar, that will pivot the bar 30 in a direction tending to relax the strings 14 (thereby decreasing their pitch). Pivoting the handle 68 to decrease the pitch of the string requires the musician to overcome the downward biasing force of the spring 74. While the force of the spring 74 is sufficient to resist the moment which is applied by the tuned strings alone, that biasing force can be overcome manually and with little relative difficulty by the musician. Conversely, the handle may be pivoted in the opposite direction to raise the pitch of the strings 14. When thus operated, the rear end of the bar 30 moves downwardly, away from the spring 74, which remains seated on the shoulder 90 of the nut 88. Operation of the tremolo device in either mode requires that the musician apply forces of approximately equal magnitude to the handle 68, the force in one case being required to increase the tension on the strings 14 and in the other case to overcome the biasing force of the spring 74. When the handle 68 is released, the bar 30 returns to its normal position in engagement with the underside of the forward end 80 of the spring 74 which is maintained in seating engagement on the shoulder 90 of the nut 88. The slot 98 enables the bar 30 to pivot up and down without interfering with the nut 88.

FIGS. 8-11 illustrate a modified embodiment of the invention in which the spring arrangement includes a pair of springs, including an upper leaf spring **80*a* and a lower leaf spring 80*b*. The upper leaf spring 80*a* is similar to the leaf spring 80 described in connection with the embodiment shown in FIGS. 1-5 except that the spring 80*a* is selected to develop less of a downwardly biasing force to the rearwardly extending portion of the tremolo bar 30. The upper spring 80*a* has a slot 96 which is wide enough only to receive the narrowed portion 93 of the nut 88. Thus, the free, forward end of the spring 80*a* is limited in its downward movement so that it cannot move below the surface defined by the shoulder 90 on the nut 88. The lower spring 80*b* is provided with a slot 96*b* at its forward end. The slot 96*b* is wide enough to permit the free end of the lower spring 80*b* to move downwardly below the level of the shoulder 90 on the nut 88. The dimensions and spring constant (and the extent to which the nut 82 is tightened) are selected so that neither of the springs 80*a*, 80*b* is itself sufficient to maintain the tremolo bar in its "normal" configuration. Rather, the springs are selected so that their additive biasing force is required in order to maintain the tremolo bar in the normal configuration illustrated in FIG. 8. More particularly, the lower spring 80*b* is selected and tightened so that the tremolo bar would tend to raise the lower spring 80*b* slightly above the level of the shoulder 90. The upper spring 80*a*, however, is selected to provide an additional downward bias to the lower spring 80*b* so that their additive effects will cause the free end of the upper spring 80*a* to rest on the shoulder 90**, thus maintaining the tremolo bar in a "normal" configuration.

Figure 9:
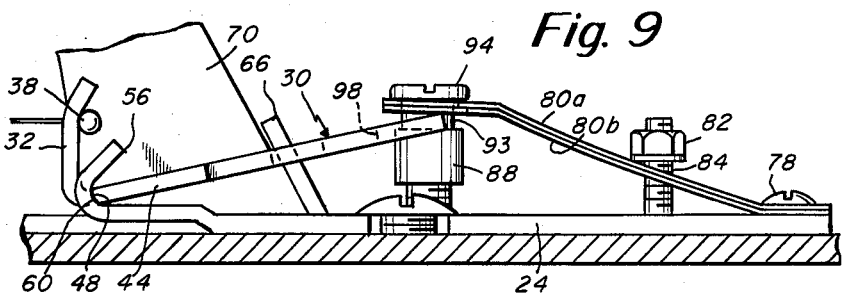
FIG. 9 is an illustration of the device shown in FIG. 8 in a string-relaxing configuration.
Figure 10:
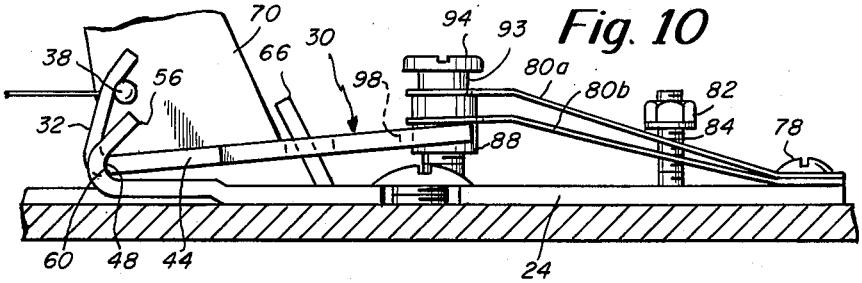
FIG. 10 is an illustration of the device shown in FIG. 8 in a string-tensioning configuration.
Figure 11:
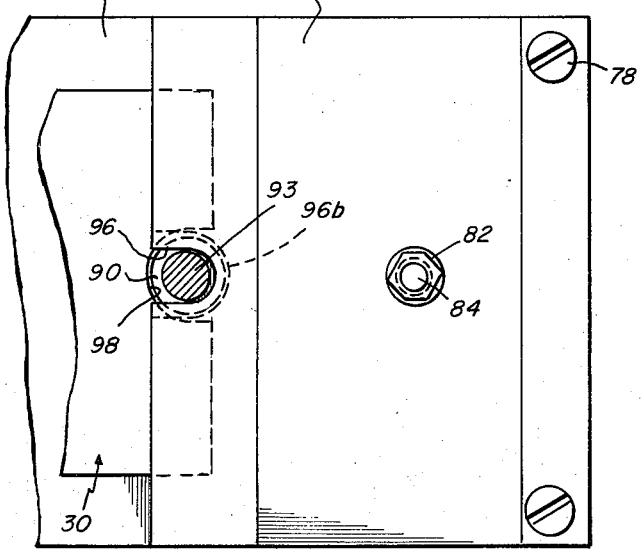
FIG. 11 is an illustration of the device as seen along the line 11—11 of FIG. 8.

As shown in FIG. 9, when the tremolo bar is provided in a direction to relax the strings, the rearwardly extending end of the tremolo bar 30 must overcome the biasing effect of both springs **80*a*, 80*b*. As shown in FIG. 10, when the tremolo bar 30 is pivoted in the opposite, string-tensioning direction, the springs 80*a*, 80*b* will separate and the lower spring 80*b* will provide partial assistance to the user to bias the rearwardly extending portion of the tremolo bar 30 downwardly. It has been found that this configuration of two springs, in which the free end of the lower spring can move without restriction by the nut 88**, provides for a very smooth and balanced feel for the user.

Figure 7:
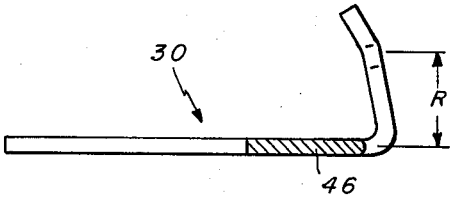
FIG. 7 is an elevation of the anchor portion shown in FIG. 6.
Figure 8:
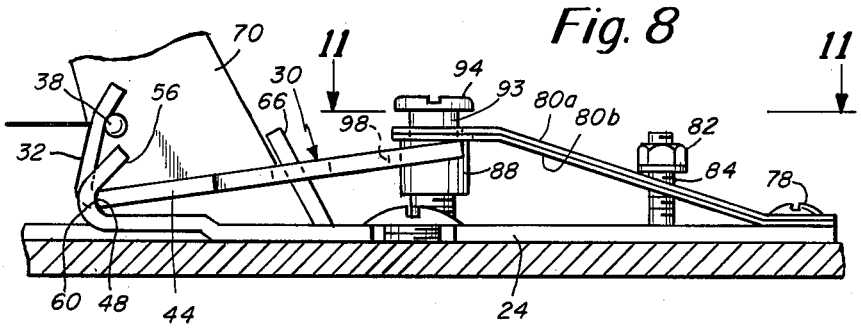
FIG. 8 is a side elevation of another embodiment of the invention employing a pair of leaf springs arranged to present a more balanced feel for the user.

In each embodiment, the configuration of the tremolo bar 30 and the base plate 24 preferably is such that when the tremolo bar is in its normal position the tail ends of the strings 14 will extend along a direction which is substantially perpendicular to the radius of action R of the tremolo bar (FIG. 7). As used here, the term "radius of action" refers to the radius defined between the pivot axis 60 and the point of attachment of the string 14 to the anchor portion 32 of the tremolo bar 30. By initially orienting the normal configuration of the device so that the tail ends of the strings are at substantially right angles to the radius of action, the direction in which the strings are tensioned or relaxed extends longitudinally of the strings and has no significant component of movement in a vertical direction. In this regard it should be noted that if the tail ends of the strings are moved vertically as well as longitudinally (because the point of attachment of the string moves through an arc) that could result in undesirable variations in the linear stretching (or relaxing) associated with each string during operation of the tremolo device. By maintaining the tail ends of the strings substantially tangent to the arc of movement of the point of attachment of the string such vertical movement of the tail end of the string is minimized. This, in conjunction with the fact the arc of movement is comparatively small results in an arrangement in which there is no significant vertical movement of the tails of the strings.

Preferably, the tail piece 20 includes a cover 100 which may be formed from an appropriate plastic material. The cover 100 is provided with a hole 102 in its top surface through which the screw head 92 of the nut 88 may be reached. An opening 104 may be provided at the forward end of the housing 100 through which the strings 14 may pass and an opening 106 also may be formed in the housing 100 so that the extension bracket 70 of the bar 30 may extend out of the housing 100.

Also, among the advantages of the invention is that it provides a simple and rapid means by which the strings 14 may be returned in unison simply by turning the nut 88 in one direction or the other. The screwhead 94 is accessible at all time through the opening 102 in the housing 100. This is particularly desirable when playing in a group in which all of the instruments must be in tune with each other. Although the guitar's strings may be tuned properly relative to each other, it is not uncommon for the guitar to be slightly out of tune with the other instruments in the band. By raising or lowering the nut 88, the height of the shoulder 90 can be adjusted, thereby varying the lower position of the rear end of the tremolo bar 30. Thus, the tuning of the strings 14 may be raised or lowered in unison, within the range of a few notes by simply turning the screwhead 94 in the appropriate direction.

Another advantage of the invention is that, in the event that a string breaks, that will not throw all of the other strings out of tune. With prior tremolo devices, in which the moment of the strings is counterbalanced entirely by a free spring force, breaking of a string reduces the moment applied by the remaining strings to the tremolo device which, in turn, causes the main counterbalancing spring to increase the tension on the remaining unbroken strings. This can present a particularly awkward situation for a professional musician in concert. When the remaining unbroken strings go out of tune, that ordinarily disables the instrument from being used at all for the remainder of the piece then being played. With the present invention, it may be possible to continue playing the piece (although with one less string), although perhaps not with the full facility as there might have been had the string not broken. In any event, the instrument is not completely disabled.

In accordance with the invention, the bridge and nut (see bridge 18 of FIGS. 1 and 2) are not frictional devices but, instead, are grooved rollers. This further avoids the problem which occurs with a conventional bridge when stretching or relaxing the string, i.e., that the strings do not return to their precise original position due to friction and may end up being slightly out of tune. The frictionless effect of the rollers minimizes this.

From the foregoing, it will be appreciated that the invention provides an improved tremolo device for a guitar or the like which enables the tremolo to be effected either in a higher pitch direction or a lower pitch direction than the tuning to which the strings were originally set. The strings return to their normal preset tuning when the bar 30 is released and permitted to return to its normal position. In addition, when one or two individual strings are "bent", the force applied to the tremolo bar 30 is resisted uniformly by the spring 74 which maintains the bar and, particularly its anchor portion 32 in a rigid configuration. Thus, bending a note does not shift any of the other strings out of tune. Also contributing to this feature is the manner in which the strings 14 are attached to the anchor portion 32, in that any increased tension applied to a string will be taken up and will not be noticeably transferred to any of the other fingers 40 which hold the other strings 14. Moreover, these advantages are incorporated into a device which enables the entire tuning of the instrument to be transposed within a range of a few notes which, is most instances, will be sufficient.

In addition, it should be noted that when the strings are stretched or relaxed, an identical amount of stretching will not produce uniform changes in pitch. Rather, with lower pitched strings which typically have larger diameter, less stretching of the string is required to raise such a string one whole musical note than is required for a correspondingly higher pitched string. Thus, in order to assure that a chord will remain true while using the tremolo device, the slots 34 are not of uniform depth. Rather, the slots 34 and the lower terminal holes 36 are disposed at varying heights on the anchor portion 32 of the bar 30 so that each string will move through an arc of different radius (with respect to the pivot axis) when the tremolo bar 30 is operated. In this manner, each string will be stretched or relaxed by just that amount to maintain all the strings in proper relative tuning. The radii of action (as measured from the pivot axis to the point of attachment of the strings) are selected so that each string will be stretched (or relaxed) by just that amount to maintain the chord in tune throughout the tremolo.

Figure 6:
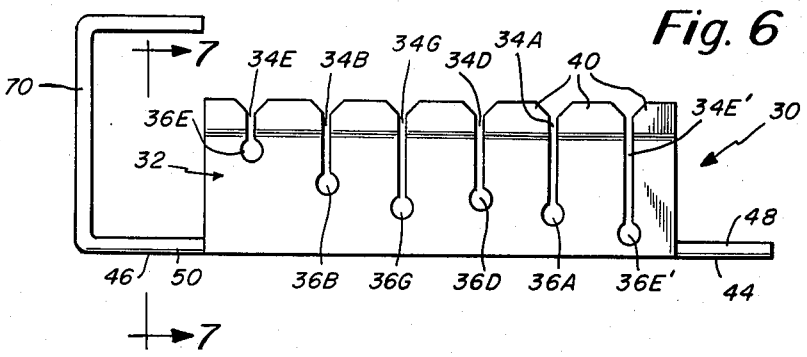
FIG. 6 is an elevation of the anchor portion of the tremolo bar.

While, in general, lower pitched strings require less stretching (or relaxing), I have found that in instruments (such as guitars) which have both wound and unwound strings, the degree of stretching required for some of the wound strings is less than the required for the unwound strings. For example, a six-string guitar typically has to groups of strings including a first group of three unwound strings and a second group of wound, lower pitched strings. Within each group, the higher pitched string requires greater stretching than the lower pitched strings in order to maintain a uniform pitch change when all are stretched simultaneously. However, the differences between the unwound and wound strings are such that the highest pitched of the wound strings (which is pitched lower than the lowest pitch of the unwound strings) requires a degree of stretching (or relaxing) which is intermediate that of the highest and lowest pitched unwound strings. The remaining two of the wound strings require progressively less stretching than the highest pitch of the wound strings. Thus, as illustrated in FIGS. 3, 6 and 7 the anchor portion of the tremolo bar may be considered as being provided with a first group of string-receiving slots 34E, B and G (in which the letter suffix corresponds to the normal string pitch) and a second group of string-receptive slots for the wound strings indicated at 34D, A and E'. In each group, the radius R (see FIG. 7) from the pivot axis to the point of string attachment 36 is greatest for the highest pitched string and decreases progressively to the lowest pitched string. The radius R defined by the point of attachment 36D, however, is not less than that of 36G but, rather, is intermediate that of 36E and 36G.

I have found that ratios exist between the radii R for the various strings which tend to give optimum results. Thus, for a conventional six-string guitar which is conventionally strung and tuned, the radius R defined by the point of attachment 36E may be considered as unity. The radii R defined by the remaining points 36B, 36G, 36D, 36A and 36E' may be expressed as an approximate percentage of the radius of the point 36A, as follows: 36B—63%; 36G—43%; 36D—51%; 36A—40%; 36E' 20%. It will be appreciated that the same percentages apply to the linear amount which the respective strings is stretched or relaxed. Specifically, I have found that with a radius associated with the point 36E of 0.350 inches, the remaining points of attachment 36 may define radii as follows: 36B—0.220"; 36G—0.150"; 36D—0.180"; 36A—0.140"; and 36E'—0.70".

It may be noted that although the illustrative embodiment of the invention illustrates the strings being attached to the bar by means of grooves or slots 34 terminating in openings 36, the foregoing feature of the present invention may be incorporated into other tailpiece devices having string attaching means other than the grooves illustrated. For example, the strings may be secured at their attachment points by way of a variety of hooks, apertures or other equivalent means.

It should be understood that the foregoing description of the invention is intended merely to be illustrative thereof and that other embodiments and modifications may be apparent to those skilled in the art without departing from its spirit.

Having thus described the invention, what I desire to claim and secure by Letters Patent is:

1. A tailpiece unit for a stringed instrument having a body and a bridge; the tailpiece unit comprising:

a tremolo bar mounted to the body at a location behind the bridge, the tremolo bar including means to enable the tails of the strings to be attached thereto;

said tremolo bar being mounted for movement from a predetermined normal position in a string-tensioning and string-relaxing direction to enable the strings to be tensioned or relaxed;

restraining means normally in engagement with the tremolo bar for resisting the force applied to the tremolo bar by the tension of the strings thereby to hold the tremolo bar in said predetermined normal position;

said restraining means being resilient to enable the restraining means to yield in response to movement of the tremolo bar in a string-relaxing direction beyond said predetermined normal position in response to an externally applied force on the tremolo bar, said restraining means being further constructed and arranged to bias and return the tremolo bar to said predetermined normal position upon release of said external force;

said tremolo bar and restraining means being constructed to enable the tremolo bar to be moved in either direction with respect to said predetermined normal position;

stop means engageable with the restraining means to limit the extent to which the restraining means may move in a string-tensioning direction to define a normal position for the restraining means; and means for varying the position of the stop means thereby to vary the normal position of the restraining means, thereby to vary the predetermined normal position of the tremolo bar.

2. A device as defined in claim 1 further comprising:

said tremolo bar being mounted for limited pivotal movement about a transversely extending pivot axis to enable the bar to be oscillated about said pivot axis;

said restraining means being engageable with the tremolo bar at a location which is spaced from the pivot axis;

said tremolo bar having a forward portion and a rearward portion, the strings being attached to the forward portion, said pivot axis being located below the point of attachment of the strings to the forward portion of the tremolo bar;

said restraining means comprising spring means in engagement with the rearward portion of the tremolo bar for precluding the rearward portion of the tremolo bar from pivoting in a string-relaxing direction;

said stop means being engageable with the spring means to preclude it from advancing downwardly beyond a predetermined lower limit but being constructed and arranged to enable the spring means to move upwardly from said lower limit; and means for adjustably varying the height of the stop means.

3. A device as defined in claim 2 further comprising:

said spring means comprising a leaf spring secured to the body of the instrument at a location rearwardly of the tremolo bar, said leaf springhaving a forwardly extending portion which overlies the rearwardly extending portion of the tremolo bar;

said stop means comprising a nut having a shoulder portion adapted to engage the forwardly extending portion of the leaf spring;

a threaded post mounted in fixed relation to the body of the instrument and extending heightwise therefrom, the nut being threadably mounted on the upwardly extending end of the threaded post, said nut being rotatable to vary the height of the shoulder thereon, thereby varying the normal position of the forward portion of the leaf spring.

4. A device as defined in claim 3 further comprising:

said nut having a narrowed portion extending upwardly from the shoulder and terminating in a screw head;

the forwardly extending end of the leaf spring being provided with a slot adapted to receive the upwardly extending narrowed portion of the nut, the screw head portion of the nut cooperating with the slot to define the uppermost limit of movement of the leaf spring.

5. A device as defined in claim 4 further comprising a cover surrounding the tailpiece unit, said cover having an aperture therethrough to expose the head of the nut.

6. A device as defined in claim 4 further comprising: means for pre-loading the spring so that it bears downwardly against the shoulder of the nut under a force sufficient to counteract the force of the rear portion of the tremolo bar in response to the tension of the tuned strings.

7. A device as defined in claim 2 further comprising: said spring means including a pair of springs operatively associated with the tremolo bar and being constructed and arranged to apply additive forces to the tremolo bar to normally oppose the forces developed by the tension of the strings;

said stop means being engageable with one of said springs to preclude that one spring from advancing downwardly beyond a predetermined lower limit, the other of the springs being freely movable without interference with said stop means;

whereby pivoting of the tremolo bar in a string-relaxing direction will be in opposition to the biasing force of both springs and wherein pivoting of the tremolo bar in a string-tensioning direction will be aided by the biasing force of the freely movable spring.

8. A device as defined in claim 7 further comprising: said springs each comprising a leaf spring secured to the body of the instrument at a location rearwardly of the tremolo bar, and including an upper leaf spring and a lower leaf spring, the leaf springs having forwardly extending portions which overlie the rearwardly extending portion of the tremolo bar;

said stop means comprising a nut having a shoulder portion adapted to engage the forwardly extending portion of the upper leaf spring;

the lower leaf spring having a slot formed at its forward end to define a clearance between the lower spring and the nut; and a threaded post mounted in fixed relation to the body of the instrument and extending heightwise therefrom, the nut being threadably mounted on the upwardly extending end of the threaded post, the nut being rotatable to vary the height of the shoulder thereon, thereby varying the normal position of the forward portion of the leaf springs.

9. A tailpiece unit as defined in claim 2 further comprising:

a base plate secured to the body of the instrument at a location behind the bridge;

said base plate including a pair of transversely spaced lugs extending upwardly and rearwardly from the base plate to define a pair of transversely spaced fulcrum sockets;

said tremolo bar including a pair of laterally extending projections receivable in the fulcrum sockets, said projections and fulcrum sockets defining the transverse pivot axis of the tremolo bar.

10. A tailpiece unit as defined in claim 2 further comprising:

said tremolo bar being generally L-shaped and having an upwardly extending anchor portion at its forward end and a rearwardly extending portion, the pivot axis being disposed in proximity to the forward end of the bar and below the point of attachment of the strings to the anchor portion of the bar;

the anchor portion comprising a plurality of upwardly extending transversely spaced fingers defining a plurality of laterally spaced grooves, each groove being receptive to the tail end of a string.

11. A tailpiece unit as defined in claim 2 further comprising;

said tremolo bar being generally L-shaped and having an upwardly extending anchor portion at its forward end and a rearwardly extending portion, the pivot axis being disposed in proximity to the forward end of the bar and below the point of attachment of the strings to the anchor portion of the bar;

the points of attachment of the strings being displaced from the pivot axis by different amounts whereby the radius of action defined from the pivot axis to the points of attachment of the strings will vary from string to string, said varying radii of action being selected to effect a uniform change in pitch of all strings in response to pivoting of the tremolo bar.

12. A tailpiece unit as defined in claim 11 wherein said stringed instrument included a first group of unwound strings and a second group of wound strings and wherein the tailpiece unit further comprises;

the radii of action associated with the string receiving grooves for the unwound strings being of descending magnitude from the highest pitched to the lowest pitched of the unwound strings;

the radii of action associated with the grooves for the wound strings being of descending magnitude from the highest pitch to the lowest pitch of the wound strings;

the radius associated with the groove for the highest pitch of the wound strings being intermediate the radii associated with the grooves for the highest and lowest pitched unwound strings.

13. A tailpiece unit as defined in claim 12 wherein said stringed instrument comprises a conventionally strung, six-stringed guitar having unwound E, B, and G strings and wound D, A and E strings, the radii of action associated with the points of attachment for said strings being substantially in the ratio of 1, 0.63, 0.43, 0.51, 0.40 and 0.20, respectively.

14. A tailpiece unit as defined in claim 2 wherein said tremolo bar and its means to enable the tails of the strings to be attached thereto are constructed and arranged so when the tremolo bar is in said predetermined position, the radii of action associated with said strings will extend substantially perpendicular to the direction of the tails of the strings, said radii of action extending from the pivot axis to the points of attachment of said strings.

15. A device as defined in claim 1 further comprising:

said tremolo bar being mounted for limited pivotal movement about a transversely extending pivot axis to enable the bar to be oscillated about said pivot axis;

said tremolo bar having a forward portion and a rearward portion, the strings being attached to the forward portion, said pivot axis being located below the point of attachment of the strings to the forward portion of the tremolo bar;

said restraining means comprising spring means in engagement with the rearward portion of the bar for precluding the rearward portion of the bar from pivoting in a string-relaxing direction;

said stop means being engageable with the spring to preclude it from advancing downwardly beyond a predetermined lower limit but being constructed and arranged to enable the spring to move upwardly from said lower limit; and means for preloading the spring so that it bears downwardly against the stop means under a force sufficient to counteract the force of the rear portion of the tremolo bar in response to the tension of the tuned strings.

16. A device as defined in claim 15 further comprising means for adjusting the preloading of the spring.

17. A tailpiece unit for a stringed instrument having a body and a bridge, the tailpiece unit comprising:

an anchor member mounted to the body at a location behind the bridge and having means to secure the tails of the strings thereto;

said anchor member being movable in a string-tensioning and string-relaxing direction;

spring means mounted to the body;

stop means mounted to the body, said spring means and stop means being arranged so that the spring means may forcefully bear against the stop means;

said anchor member, and spring means being operatively associated with each other so that the force of the strings on the anchor member causes the anchor member to bear against the spring means with a force which opposes the force of the spring means;

the force with which the spring means bears against the stop means being greater than the force with which the strings cause the anchor member to bear against the spring means whereby engagement of the anchor member with the spring means may define a predetermined normal position for the anchor;

means for adjusting the position of the stop member thereby to adjust the normal position of the spring means whereby the predetermined normal position of the anchor means may be adjusted;

said anchor means, stop means and spring means being constructed and arranged to enable the anchor means to be moved from said predetermined normal position in string-relaxing and string-tensioning directions.

18. In a stringed instrument having a body, a bridge, an anchor member mounted to the body at a location behind the bridge, the anchor member having means to secure the tails of the strings thereto and being movable in a string-tensioning and string-relaxing direction, the instrument further having means biasing the anchor member in a string-tensioning direction, the improvement comprising:

stop means engageable with the bias means to limit the extent to which the bias means can urge the anchor member in a string-tensioning direction and means for adjusting the position of the stop means.

19. A tailpiece unit for stringed instrument having a body and bridge, the tailpiece unit comprising:

an anchor member mounted to the body at a location behind the bridge and having means to secure the tails of the strings thereto;

said anchor member being movable in a string-tensioning and string-relaxing direction;

bias means engageable with the anchor member for biasing the anchor member in a string-tensioning direction;

stop means engageable with the bias means to limit the extent to which the bias means can urge the anchor member in a string-tensioning direction; and means for adjusting the position of the stop means.

20. A device as defined in claim 19 further comprising means for varying the biasing force of the bias means.

21. A tailpiece unit for a stringed instrument having a body and a bridge, the tailpiece unit comprising:

an anchor member mounted to the body at a location behind the bridge, the anchor member having means by which the tails of the strings may be attached thereto;

means mounting the anchor member to the body for movement in a string-tensioning and string-relaxing direction;

biasing means engageable with the anchor member for retaining the anchor member in a predetermined normal position;

said biasing means comprising spring means and a stop member, the spring means normally bearing against the stop member when the device is in its predetermined normal position, the force with which said spring means bears against the stop member being greater than that which the anchor member applies to the spring means when the device is in its predetermined normal position, whereby the predetermined normal position of the anchor is determined by the position of the stop means; and means for adjusting the position of the stop means.

* * * * *